United States Patent [19]

Kabátek et al.

[11] Patent Number: 4,874,249

[45] Date of Patent: Oct. 17, 1989

[54] ARRANGEMENT FOR CONTINUOUS MIXING OF LIQUIDS

[75] Inventors: Jan Kabátek; Pavel Ditl, both of Praha, Czechoslovakia

[73] Assignee: České vysoké učení Technické, rektorát, Praha, Czechoslovakia

[21] Appl. No.: 254,622

[22] Filed: Oct. 7, 1988

[30] Foreign Application Priority Data

Oct. 7, 1987 [CS] Czechoslovakia ..... 7210-87

[51] Int. Cl.[4] ..... B01F 5/06

[52] U.S. Cl. ..... 366/339

[58] Field of Search ..... 366/336, 337, 338, 339; 138/38, 42

[56] References Cited

U.S. PATENT DOCUMENTS

| | | | |
|---|---|---|---|
| 3,286,992 | 11/1966 | Armeniades | 366/339 |
| 3,827,888 | 8/1974 | Gingello | 366/339 |
| 4,050,676 | 9/1977 | Morishima | 366/339 |
| 4,511,258 | 4/1985 | Federighi | 366/338 |

*Primary Examiner*—Robert W. Jenkins

*Attorney, Agent, or Firm*—Notaro & Michalos

[57] ABSTRACT

A mixing arrangement is provided for continuous mixing of liquids which comprise a plurality of inserts with helical surfaces disposed in a row within a conduit. The inserts each comprise a plurality of helical insert members which, at the inlet end of the inset, are in mutual contact and form a polygon at that end. The insert members extend individually from the inlet end along the conduit. The insert members are also in contact at the outlet end of the insert or at a location between the inlet and outlet.

3 Claims, 2 Drawing Sheets

ARRANGEMENT FOR CONTINUOUS MIXING OF LIQUIDS

FIELD OF THE INVENTION

The invention relates to an arrangement for mixing of liquids and, in particular, for the homogenization of mutually mixable liquids which are viscous and less viscous, for dispersing of liquids and gases in liquids, for the intensification of heat transmission at flowing liquids, for the creation of a suitable interphase surface in homogenous reactions, for emulsifying, for partial mixing and the like.

BACKGROUND OF THE INVENTION

Prior art arrangements for continuous mixing of liquids employ different kinds of mixing elements built in into conduits. These built-in mixing elements generally comprise different helically shaped surfaces, suitably situated with the conduits, and shaped blades or vanes, crossing channels, shaped plates and the like.

Drawbacks of mixing arrangements which use blades, vanes and channels include the associated high pressure losses and the tendency thereof to clogging. Drawbacks of mixing arrangements using helical mixing surfaces include the relatively large length required to provide thorough mixing and, more importantly, the reduction of the mixing efficiency thereof in the course of transition hydrodynamic conditions.

SUMMARY OF THE INVENTION

It is an object of this invention to provide a continuous mixing arrangement for liquids, comprising helical inserts in a conduit, which arrangement is of reasonable length, but which provides very intensive mixing with low pressure losses. The arrangement according to the invention comprises a number of inserts having helical surfaces, arranged in a row in a conduit, the inlet ends of each insert forming a polygon. The inserts each comprise a plurality of helical insert members, which are disposed relative to one another and extend along the conduit in such a manner, that the helical insert members are in mutual contact at the inlet end of the insert and also at the outlet end of the insert or at a location between the inlet and outlet. The widths of the insert members can be different along their lengths, and can be larger or smaller than the length of a side of the inlet polygon. Gaps are thus created between individual helical insert members, with the area of the gaps of an insert being a multiple of 0.2 to 3 times of the area of the polygon at the inlet of the insert. The longitudinal edges of the insert members which are closest to the internal surface of the conduit are advantageously directed towards the corners of the polygon of the following insert in the row.

The main advantage of the arrangement according to this invention is that the arrangement will provide intensive mixing of viscous and less viscous liquids, as well as the emulsion and dispersion of gases in liquid and/or partial mixing thereof, even through the length of the whole arrangement is reasonable, and pressure losses are low.

Other features and advantages of the invention will be set forth in, or apparent from, the detailed description of preferred embodiments of the invention which follows.

BRIEF DESCRIPTION OF THE DRAWINGS

The arrangement according to this invention will be described below in more detail in connection with the accompanying drawings showing exemplary embodiments thereof, wherein.

DESCRIPTION OF THE PREFERRED EMBODIMENTS

Figure 1:
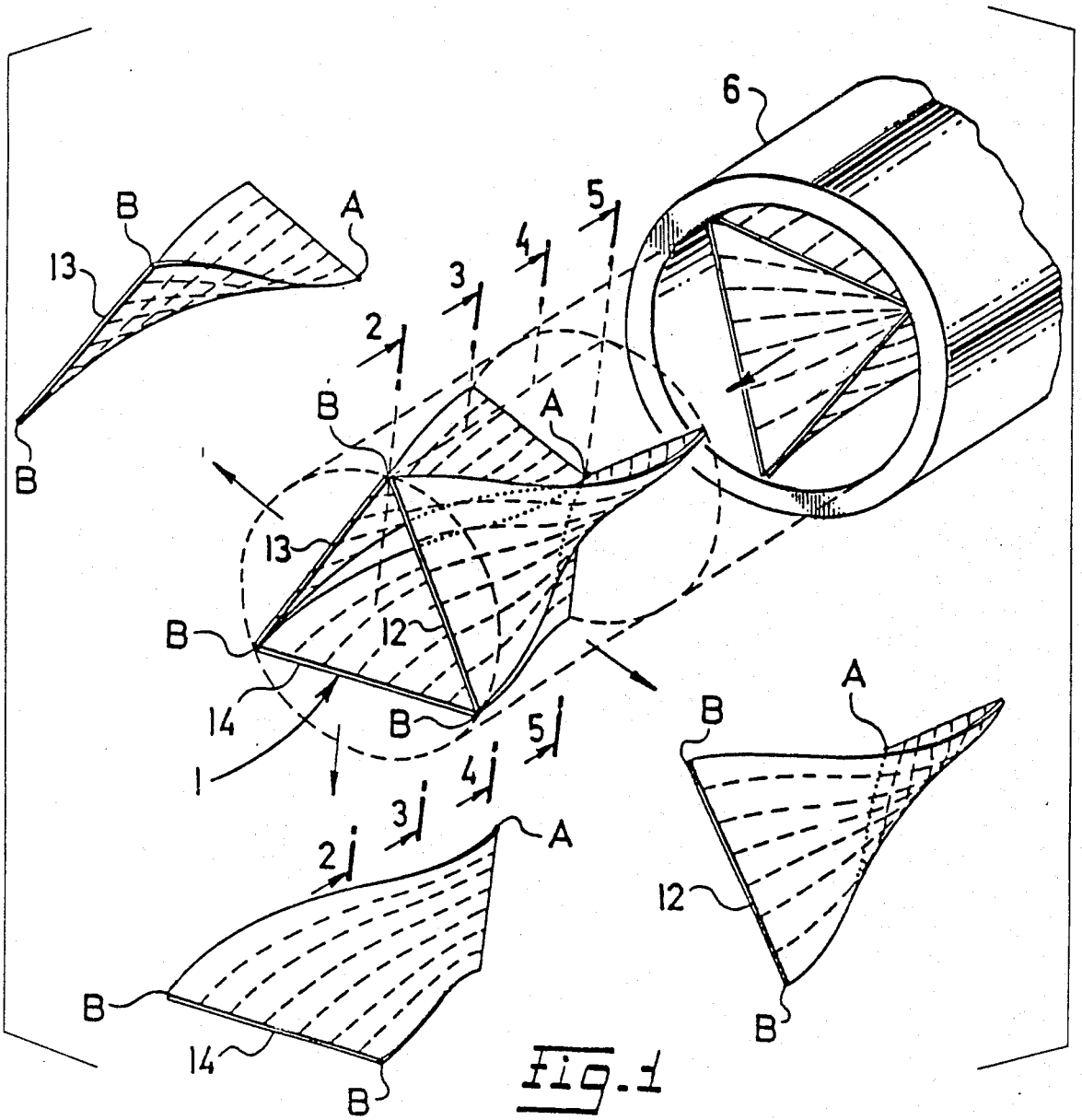
FIG. 1 is an exploded perspective view of an insert forming a triangle base at the front inlet of an associated conduit, wherein individual helical members forming the insert are also shown separately for purposes of clarity of illustration.

With reference to FIG. 1, the arrangement of the invention basically comprises an insert 1 adapted to be inserted into a conduit 6. This insert 1 comprises, according to the embodiment of FIG. 1, three equal helical insert members 12, 13, 14, which are mutually connected together at the inlet edges thereof at locations indicated at B so that these inlet edges form a polygon, in this case, a triangle, with the helical members 12, 13 and 14 extending inwardly or rearwardly of that triangle, as shown. The insert 1 is shown in FIG. 1 as being in front of a conduit 6 into which it is to be inserted.

A second insert is also shown in conduit 6, which would immediately follow the first insert deeper in the conduit.

For purposes of clarity, the individual helical members 12, 13, and 14 are also illustrated separately in FIG. 1, apart from insert 1, wherein lines along the surfaces thereof which extend substantially parallel with the lateral edges of the members indicate the contour of the members.

According to the embodiment shown in FIG. 1, the corners of the outlet edges of all three helical members 12, 13, 14 are also mutually connected together at the location wherein the lateral edge of each twisted helical member which extends toward the axis of the insert 1 meets the corresponding lateral edges of the other helical members at the axis of the insert 1, i.e., at a location A which is thus common to all three helical members 12, 13, and 14. Further, as shown, the opposite lateral edges of the helical members are disposed close to the internal surface of the conduit 6. Thus gaps are created between individual members 12, 13 and 14, the size of which depends on the shape of the members. In the illustrated embodiment, the shape is that of a quadrangle with the length of the base being 3/2 of the internal diameter of the conduit 6 and with the length of the top edge being one half of this diameter. The lateral edges of the helical insert members 12, 13, and 14 can be straight or curved in order to provide a suitable area for said gaps, i.e., an area which is most suited to the viscosity of the ingredients to be mixed. One lateral edge of each helical member of the insert always remains close to the internal surface of the conduit 6.

The helical insert 1 of FIG. 1 is right handed and the pitch thereof is about four times the length of the insert 1, whereby the axis of the helical surface of each insert member divides in half the width of the member at the inlet and outlet.

In a case where a plurality of inserts 1 are arranged in a row in the conduit 6, it is possible to alternate inserts 1 with a right hand or a left hand helix, either individually or in groups. Advantageously, this is done so that the ends of the longitudinal edges of helical members forming an insert 1 which are close to the internal surface of the conduit 6 are directed toward the corners of the inlet polygon of the following insert 1, as the first and second inserts are oriented in FIG. 1. In a case wherein inserts are provided in tubes with a larger diameter, the inserts 1 can be arranged in same positions, while being mutually not angularly displaced. Thus the mutual position of inserts 1 can be easily maintained. The inserts 1 are in this case, i.e., in an embodiment employing a triangular base, mutually displaced for 60°. By alternating inserts 1 with right and left hand helixes, the torque transmitted to the arrangement by the throughflowing liquid is compensated for.

Figure 2:
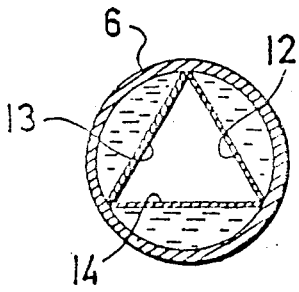
FIGS. 2 to 5 are sectional views of an insert within an associated conduit, the sections being consecutively taken along planes indicated in FIG. 1 at 2—2, 3—3, 4—4 and 5—5, respectively.
Figure 3:
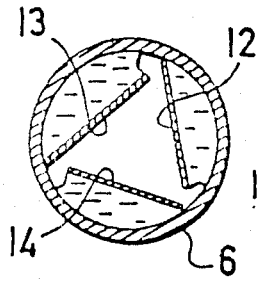
Figure 4:
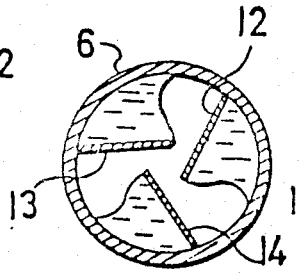
Figure 5:
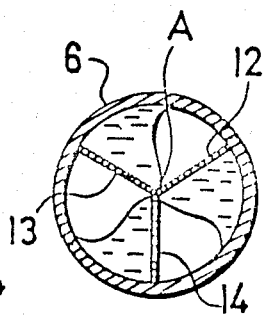
Figure 6:
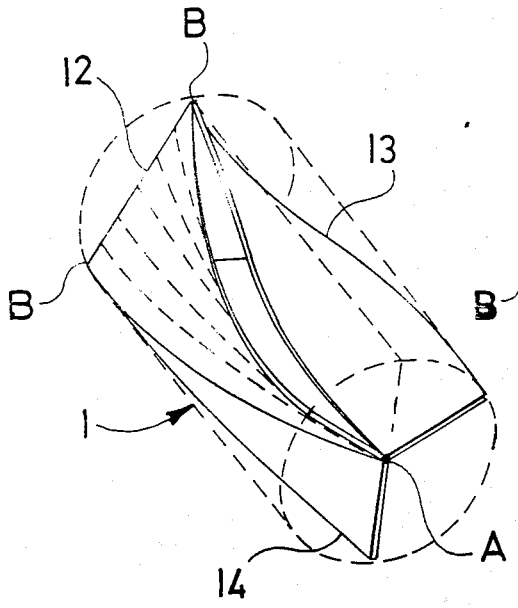
FIG. 6 is a perspective view of an insert as viewed from the outlet end, where the helical members of the insert are mutually connected together at the outlet end.

FIGS. 2 to 5 show cross sections of the insert 1 of FIG. 1, the individual sections taken at different axially spaced planes as indicated in FIG. 1 by lines 2—2, 3—3, 4—4 and 5—5. The section shown in FIG. 2 shows the basic polygon at the inlet end of the insert 1 and the section in FIG. 5 illustrates the conditions at the outlet of the insert 1. It will be appreciated that the flowing media are thereby thoroughly mixed, with the part flowing between the internal surface of the conduit 6 and the helical insert members 12, 13 and 14 being indicated by dashed lines, and the part flowing within the space created by the members 12, 13, and 14, being located within the clear (unmarked) areas of these figures. These sectional views are intended to emphasize the progress of the mixing action along the insert 1 as provided by, or due to the shape of, the insert 1.

Figure 7:
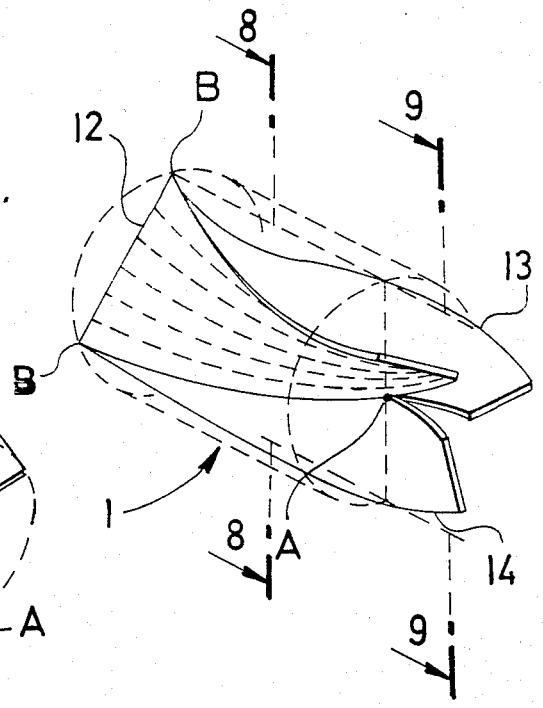
FIG. 7 is a similar perspective view of an insert wherein the helical members are mutually connected together at a location upstream of the outlet end of the insert.
Figure 8:
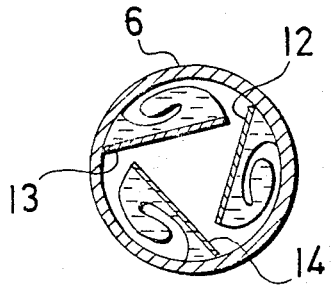
FIGS. 8 and 9 are sectional views of the insert of FIG. 7, i.e., of an insert disposed within an associated conduit wherein the helical members are connected together at a location upstream of the outlet end of the insert, the sections being taken along planes indicated in FIG. 7 at 8—8 and 9—9.
Figure 9:
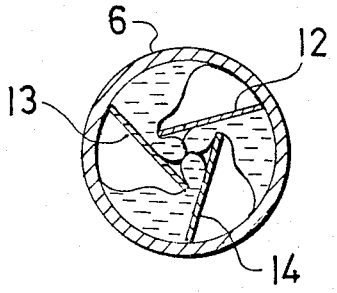

FIG. 7 shows an alternative arrangement of an insert 1 where the internal lateral edges of the insert members 12, 13, and 14 are mutually connected together at a point A which is spaced from the outlet of the insert 1 so that the outlet edges of individual insert members 12, 13 and 14 are separated. FIGS. 8 and 9 are sectional views of this alternative arrangement taken through planes indicated in FIG. 7 by lines 8—8 and 9—9, in a manner similar to the sectional views of FIGS. 2 to 5. A somewhat different penetration of both mixed parts is obvious from the drawings.

The arrangement according to the invention operates as follows. The liquid or the mixture passing through the conduit 6 is at the end of each insert 1 divided to a number of streams corresponding to the number of helical insert members 12, 13 and 14. Each stream is, at the inlet of the following insert 1, divided again by the inlet edges of the following insert 1 and separated into a part flowing inside the insert 1 and a part flowing between the insert 1 and the internal surface of the conduit 6. The liquid flowing inside the insert 1 is forced to pass through gaps between individual helical insert members 12, 13, and 14 of the insert 1, and intensive mixing takes place with the part of liquid flowing between the insert 1 and the internal surface of the conduit 6. Because the gaps or spaces referred to above can be made to be of different cross sections, variations in the amounts of throughflowing liquid, and variations in flow speeds, can be achieved, as is discernible to a degree from the sectional views in FIGS. 2 to 5 and Figures 8 and 9. Of course, when the liquid leaving a first insert 1 enters the following insert 1, a further division of streams takes place.

Because of the division of the streams at the inlet of inserts 1 and the mutual penetration of, or interaction between, the streams during the course of the passage thereof through an insert 1 having suitable gap sizes and shapes, intensive mixing is provided.

A further intensification of the mixing produced, and, in particular, of the mixing of the portion of the liquid in the central part of the insert 1 along the axis of the conduit 6 (which is less influenced by the helical members 12, 13 and 14), is provided by shifting the contact point A between lateral edges of the inset members 12, 13 and 14 to a location inboard of, i.e., upstream of, the outlet of the insert 1, as is indicated in FIG. 7.

The inserts 1 can be advantageously made of a material which is not subject to corrosion by the mixed components, in particular of plastic, by using any of a number of commonly known processes.

The arrangement according to this invention can be particularly applied to homogenization of mutually mixable liquids, dispersion of liquids and of gases into liquids, intensification of heat transmission in flowing liquids, creation of a suitable interphase surface in heterogenous reactions, emulsions, partial mixing and the like.

The arrangement exhibits a very low pressure loss, particularly in the turbulent range and very good homogenization effects, as the homogenization takes place not ony by division of streams at the inlet edges of the element, as is common in helical mixers, but also during the course of passage of the liquid through the element. The mixer requires relatively low amounts of power for homogenization as compared with commercial mixers. Further, the mixer suffers no loss of efficiency of homogenization with the range of Re 10 to 300 as is the case with other, known mixers.

Although the present invention has been described relative to exemplary embodiments thereof, it will be understood by those skilled in the art that variations and modifications can be effected in these exemplary embodiments without departing from the scope and spirit of the invention.

We claim:

1. An arrangement for continuous mixing of fluid media, said arrangement comprising a plurality of inserts with helical surfaces, arranged in a row in a conduit, each said insert comprising a plurality of helical insert members forming a polygon at the inlet of the insert, and extending along the conduit so as to create gaps between individual members, the helical insert members of each insert being mutually connected together at the inlet of the conduit and within a distance of 0.5 to one times the length of the insert, the width of each helical insert member being variable along the length thereof, whereby the overall throughflow area of the gaps between the helical insert members is about 0.2 to 3 times the area of the polygon formed at the inlet of the insert.

2. An arrangement as claimed in claim 1 wherein the pitches of helical surfaces of all of the insert members of an insert are in the same direction and the number of said helical members is equal for all inserts in the conduit.

3. An arrangement as claimed in claim 1 wherein inserts with right and left hand helixes are provided in alternating relation within the conduit after from 1 to 15 inserts.

* * * * *